US009854638B1

(12) United States Patent
Yoo et al.

(10) Patent No.: US 9,854,638 B1
(45) Date of Patent: Dec. 26, 2017

(54) LIGHTING APPARATUS

(71) Applicant: LUMENS CO., LTD., Yongin-si, Gyeonggi-do (KR)

(72) Inventors: Tae Kyoung Yoo, Yongin-si (KR); Seong Bok Yoon, Yongin-si (KR)

(73) Assignee: LUMENS CO., LTD., Yongin-si (KR)

( * ) Notice: Subject to any disclaimer, the term of this patent is extended or adjusted under 35 U.S.C. 154(b) by 0 days.

(21) Appl. No.: 15/613,223

(22) Filed: Jun. 4, 2017

(30) Foreign Application Priority Data

Jul. 22, 2016 (KR) ..... 10-2016-0093556

(51) Int. Cl.
*H05B 37/00* (2006.01)
*H05B 33/08* (2006.01)

(52) U.S. Cl.
CPC ..... *H05B 33/0857* (2013.01); *H05B 33/0809* (2013.01)

(58) Field of Classification Search
CPC ..... H05B 33/0803; H05B 33/0827; H05B 33/0809; H05B 33/0821; H05B 41/34; H05B 39/09; H05B 41/28; H05B 37/029; H05B 37/0254; H05B 37/02; H05B 33/0818; F21Y 2101/02
See application file for complete search history.

(56) References Cited

U.S. PATENT DOCUMENTS

2014/0035472 A1* 2/2014 Raj ..... H05B 33/0863 315/185 R
2015/0312983 A1* 10/2015 Hu ..... F21K 9/1355 315/186

FOREIGN PATENT DOCUMENTS

| | | | |
|---|---|---|---|
| JP | 2005011628 | A | 1/2005 |
| JP | 2012221948 | A | 11/2012 |
| KR | 20120031182 | A | 3/2012 |
| KR | 20160072534 | A | 6/2016 |

* cited by examiner

*Primary Examiner* — Minh D A
(74) *Attorney, Agent, or Firm* — Mei & Mark LLP

(57) ABSTRACT

An improved lighting apparatus includes a direct current power supply unit, a light emitting unit, and a voltage control unit located between the direct current power supply unit and the light emitting unit to control a level of a voltage applied from the direct current power supply unit to the light emitting unit. The light emitting unit includes first light emitting groups having a first correlated color temperature and being turned on at a first turn-on voltage or above and second light emitting groups having a second correlated color temperature and being turned on at a second turn-on voltage greater than the first turn-on voltage. The voltage control unit includes at least one variable resistor to control such that the second light emitting groups emit light or are prevented from emitting light, achieving a desired correlated color temperature according to a preset proportion.

12 Claims, 4 Drawing Sheets

LIGHTING APPARATUS

CROSS-REFERENCE TO RELATED APPLICATION(S)

This application claims the benefit of Korean Patent Application No. 10-2016-0093556, filed Jul. 22, 2016, the entire content of which is incorporated herein in its entirety by reference.

TECHNICAL FIELD

The present invention relates to a lighting apparatus, and more specifically to a lighting apparatus in which a voltage of a circuit is controlled using a voltage control unit during operation of first light emitting groups emitting warm white light such that second light emitting groups emit cool white light or are prevented from emitting cool white light, thereby minimizing an area of non-light emitting regions in the light emitting groups.

BACKGROUND

Some lighting apparatuses using light emitting diodes produce emotion lighting to create unique atmospheres as well as perform their inherent lighting function. White light emitted from lighting apparatuses can be divided into warm white and cool white by its correlated color temperature (CCT). Warm white gives a warm feeling whereas cool white gives a cool feeling. In the present disclosure, white light having a correlated color temperature of 3000 K or less and white light having a correlated color temperature of 5000 K or more are commonly called "warm white" and "cool white", respectively, although their correlated color temperatures are slightly different based on classification criteria. FIG. 1 illustrates a conventional lighting apparatus capable of switching warm white to and from cool white to change a lighting effect and an atmosphere. In the lighting apparatus illustrated in FIG. 1, a first light emitting unit 10 emitting warm white light and a second light emitting unit 20 emitting cool white light are arranged in such a way that the warm white light and cool white light are emitted simultaneously. The correlated color temperature of light can be controlled by optionally operating either the first light emitting unit 10 or the second light emitting unit 20. The light emitting units are selectively connected to a direct current power supply unit 1 through switches S1 and S2.

However, the use of either of the two light emitting units 10 and 20 for warm white or cool white light emission instead of both the light emitting units is costly and causes poor efficiency. Thus, there is a need for an improved approach that can provide at least a solution to problems of the existing technology.

SUMMARY

The present invention is intended to provide an improved lighting apparatus that is free from the problems of high cost and poor efficiency encountered in conventional lighting apparatuses in which a light emitting unit emitting warm white light and a light emitting unit emitting cool white light are arranged simultaneously. In an aspect of the present disclosure, either of the light emitting units is optionally operated to control the correlated color temperature of light.

A lighting apparatus according to one aspect of the present invention includes: a direct current power supply unit; a light emitting unit operating in response to a direct current voltage applied from the direct current power supply unit and including first light emitting groups having a first correlated color temperature and being turned on at a first turn-on voltage ($V_B$) or above and second light emitting groups having a second correlated color temperature and being turned on at a second turn-on voltage ($V_A$) greater than the first turn-on voltage, the first light emitting groups being connected in parallel with the second light emitting groups; and a voltage control unit located between the direct current power supply unit and the light emitting unit to control the level of a voltage applied from the direct current power supply unit to the light emitting unit wherein the voltage control unit includes at least one variable resistor to control the level of the voltage applied to the light emitting unit such that the second light emitting groups emit light or are prevented from emitting light, achieving a desired correlated color temperature according to a preset proportion.

According to one embodiment, the lighting apparatus further includes a substrate on which the first light emitting groups are arranged inside the second light emitting groups.

According to one embodiment, the first and second light emitting groups emit light sequentially according to the levels of the turn-on voltages.

According to one embodiment, each of the first light emitting groups includes one or more light emitting diodes emitting warm white light having a correlated color temperature of 3000 K or less.

According to one embodiment, each of the second light emitting groups includes one or more light emitting diodes emitting cool white light having a correlated color temperature of 5000 K or less.

According to one embodiment, each of the first light emitting groups includes one or more light emitting diodes emitting white light having a correlated color temperature of 3000 K or less and each of the second light emitting groups includes one or more light emitting diodes emitting cool white light having a correlated color temperature of 5000 K or less.

According to one embodiment, the light emitting unit emits white light having a correlated color temperature of 3000 K to 8000 K.

According to one embodiment, the voltage control unit operates in such a manner that a voltage having a level between the second turn-on voltage and the first turn-on voltage is applied to the light emitting unit to turn on only the first light emitting groups or a voltage greater than the second turn-on voltage is applied to the light emitting unit to turn on both the first and second light emitting groups.

According to one embodiment, the voltage control unit includes a T-type circuit having resistors in its branches.

According to one embodiment, the branch resistor between the central node of the T-type circuit and a positive electrode of the direct current power supply unit is a variable resistor.

According to one embodiment, the branch resistor between the central node of the T-type circuit and a negative electrode of the direct current power supply unit is a variable resistor.

According to one embodiment, the branch resistor between the central node of the T-type circuit and an input end of the light emitting unit is a variable resistor.

In the lighting apparatus of the present invention, a voltage is controlled during the operation of the first light emitting groups configured to emit warm white light such that the second light emitting groups are configured to emit cool white light or are prevented from emitting cool white light, thereby achieving a desired correlated color temperature according to a proportion preset by a user.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Preferred embodiments of the present invention will now be described with reference to the accompanying drawings. It should be noted that the drawings and embodiments described with reference to the drawings are simplified and illustrated such that those skilled in the art can readily understand the present invention.

Figure 1:
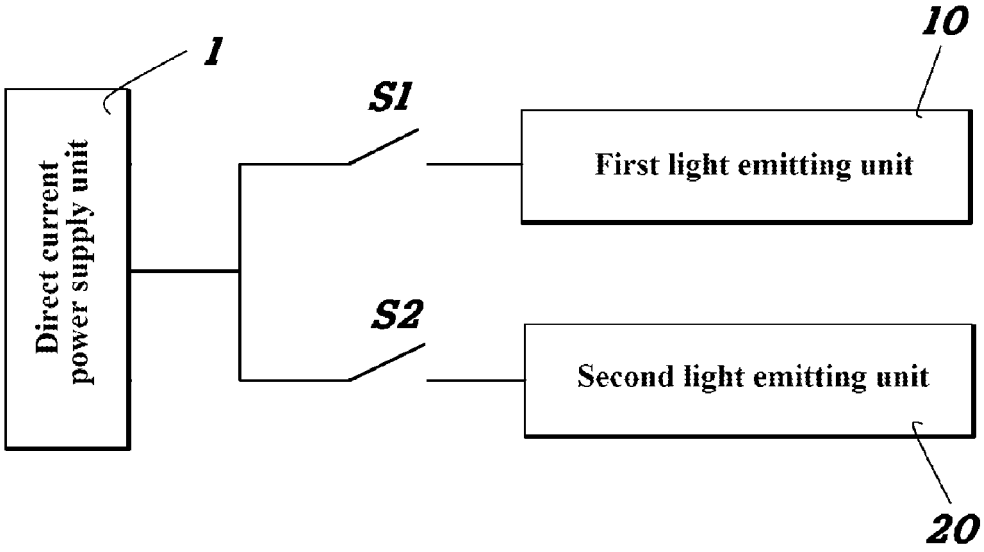
FIG. 1 (Prior art)
FIG. 1 is a block diagram of a conventional lighting apparatus.
Figure 2:
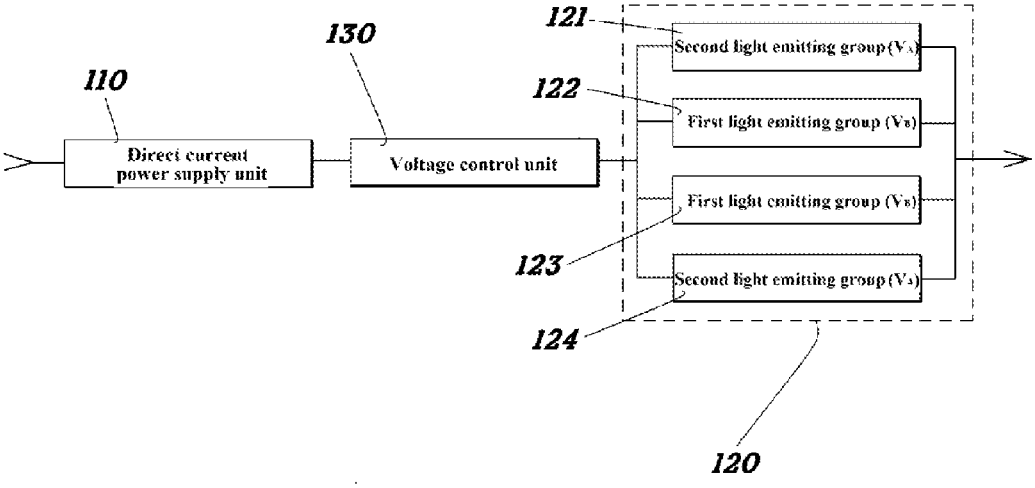
FIG. 2 is a block diagram of a lighting apparatus according to one embodiment of the present invention.
Figure 3:
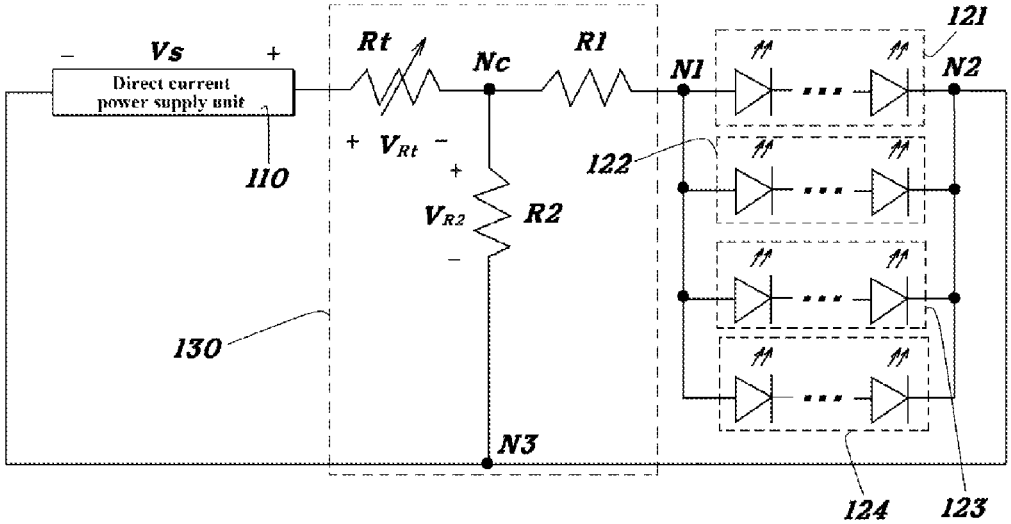
FIG. 3 is a block diagram of a lighting apparatus according to another embodiment of the present invention.
Figure 4:
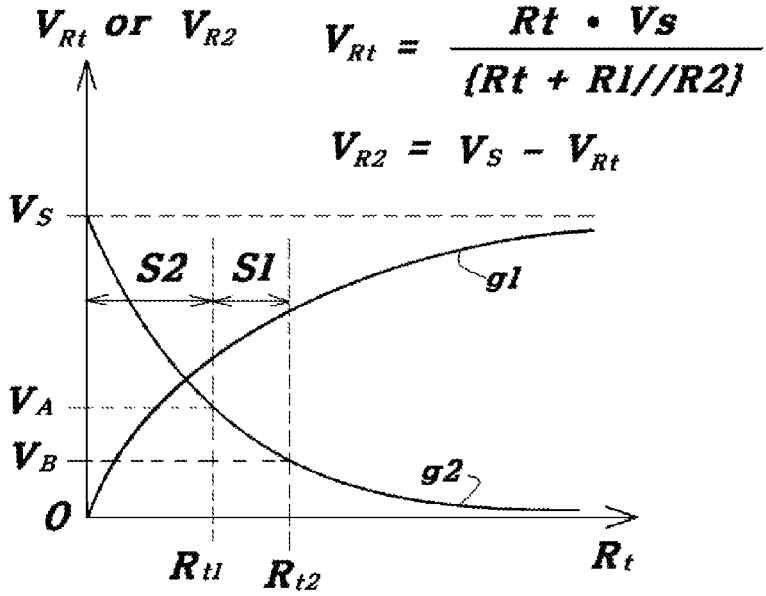
FIG. 4 graphically shows the characteristics of the voltage applied to the variable resistor Rt and the voltage applied to the resistor R2 in FIG. 3.
Figure 5:
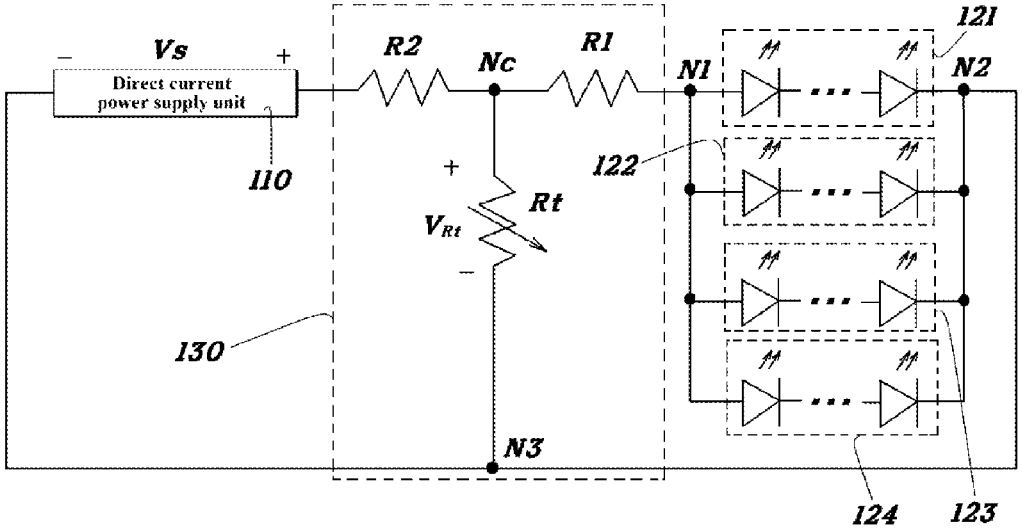
FIG. 5 is a block diagram of a lighting apparatus according to another embodiment of the present invention.
Figure 6:
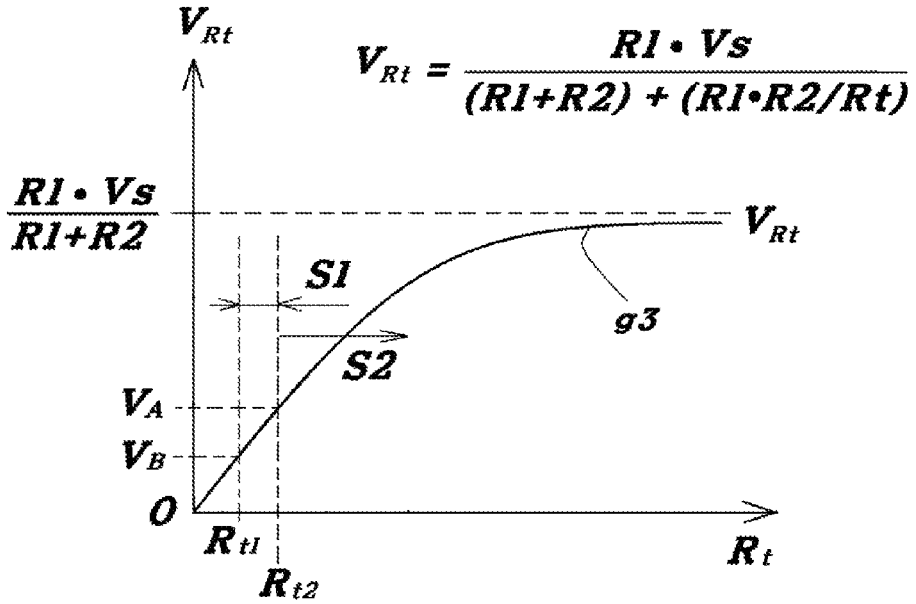
FIG. 6 is a curve showing the characteristics of the voltage applied to the variable resistor Rt in FIG. 5.
Figure 7:
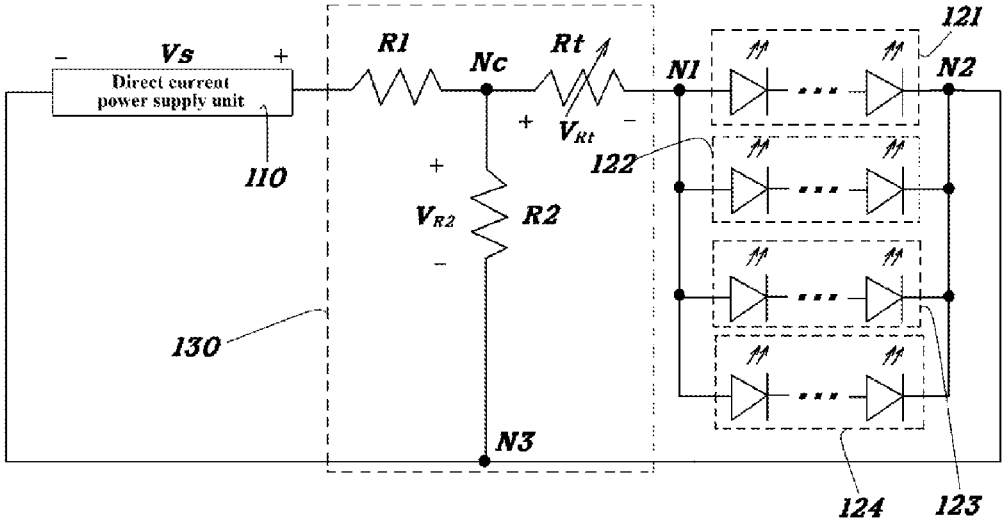
FIG. 7 is a block diagram of a lighting apparatus according to another embodiment of the present invention.
Figure 8:
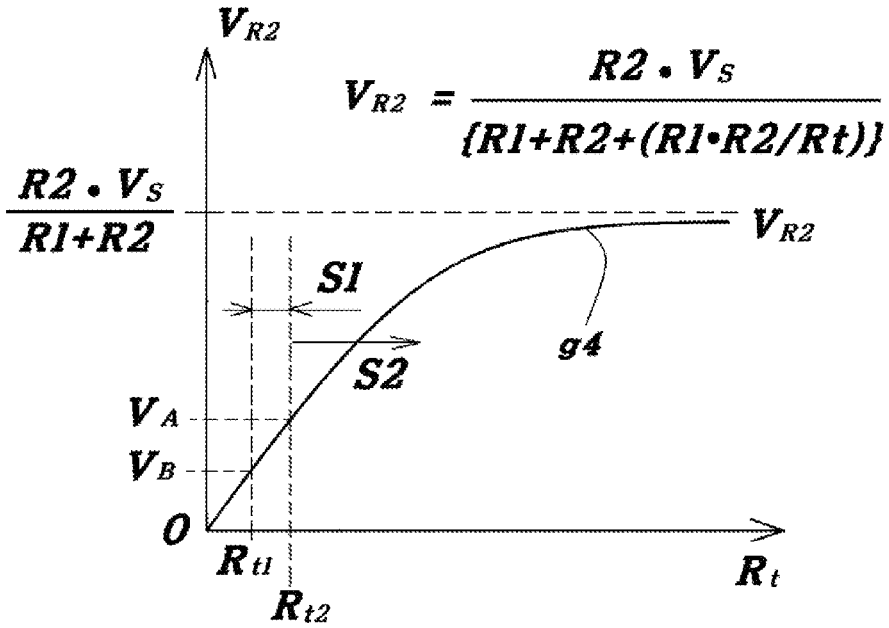
FIG. 8 is a curve showing the characteristics of the voltage applied to the resistor R2 in FIG. 7.

FIG. 2 is a block diagram of a lighting apparatus according to one embodiment of the present invention, FIG. 3 is a block diagram of a lighting apparatus according to another embodiment of the present invention, FIG. 4 graphically shows the characteristics of the voltage applied to the variable resistor Rt and the voltage applied to the resistor R2 in FIG. 3, FIG. 5 is a block diagram of a lighting apparatus according to another embodiment of the present invention, FIG. 6 is a curve showing the characteristics of the voltage applied to the variable resistor Rt in FIG. 5, FIG. 7 is a block diagram of a lighting apparatus according to another embodiment of the present invention, and FIG. 8 is a curve showing the characteristics of the voltage applied to the resistor R2 in FIG. 7.

Referring first to FIG. 2, a lighting apparatus according to one embodiment of the present invention includes: a direct current power supply unit 110; a light emitting unit 120 operating in response to a direct current voltage applied from the direct current power supply unit 110; and a voltage control unit 130. The level of the voltage applied to the light emitting unit 120 is controlled such that particular light emitting groups of the light emitting unit 120 emit light or are prevented from emitting light, achieving a desired correlated color temperature according to a proportion preset by a user.

The direct current power supply unit 110 may be a direct current power source. Alternatively, the direct current power supply unit 110 may be a source that receives alternating current power, converts the alternating current into a direct current through a rectifier circuit, an AC-DC converter, etc., and provides the direct current voltage to the light emitting unit 120.

The light emitting unit 120 includes first light emitting groups 122 and 123 and second light emitting groups 121 and 124, which have different turn-on voltages and correlated color temperatures. The first light emitting groups 122 and 123 are turned on at a first turn-on voltage $V_B$ or more and have a first correlated color temperature. The second light emitting groups 121 and 124 are turned on at a second turn-on voltage $V_A$ or more and have a second correlated color temperature. Here, the first turn-on voltage $V_B$ is lower than the second turn-on voltage $V_A$. The first correlated color temperature of the first light emitting groups 122 and 123 of the light emitting unit 120 may be 3000 K or less. The second correlated color temperature may be 5000 K or more. The light emitting unit 120 can emit white light having a correlated color temperature of 3000 K to 8000 K over its entire area.

As illustrated in FIG. 2, the two first light emitting groups 122 and 123 are distinguished from each other and the two second light emitting groups 121 and 124 are distinguished from each other. The first light emitting groups 122 and 123 are arranged inside the second light emitting groups 121 and 124. All of the light emitting groups 121, 122, 123, and 124 are arranged in parallel with one another. Alternatively, the light emitting unit may include three first light emitting groups and three second light emitting groups. Also in this case, the three first light emitting groups are distinguished from one another and the three second light emitting groups are distinguished from one another. All of the light emitting groups are arranged in parallel with one another.

The voltage control unit 130 serves to control the level of a voltage applied from the direct current power supply unit 110 to the light emitting unit 120. The circuit configuration of the voltage control unit 130 and the location of the voltage control unit 130 in the lighting apparatus may vary. The voltage control unit 130 operates in such a manner that a voltage having a level between the second turn-on voltage $V_A$ and the first turn-on voltage $V_B$ is applied to the light emitting unit 120 to turn on only the first light emitting groups 122 and 123 or a voltage greater than the second turn-on voltage $V_A$ is applied to the light emitting unit 120 to turn on both the first light emitting groups 122 and 123 and the second light emitting groups 121 and 124. That is, depending on the level of the voltage controlled by the voltage control unit 130, the light emitting unit 120 operates in such a manner that only the first light emitting groups 122 and 123 are turned on or the first light emitting groups 122 and 123 and the second light emitting groups 121 and 124 are turned on simultaneously.

The first light emitting groups 122 and 123 of the light emitting unit 120 include one or more light emitting diodes emitting warm white light having a first correlated color temperature of 3000 K or less. The second light emitting groups 121 and 124 include one or more light emitting diodes emitting cool white light having a second correlated color temperature of 5000 K or less. Generally, the turn-on voltage tends to increase with increasing correlated color temperature. Accordingly, the first turn-on voltage $V_B$ of the first light emitting groups 122 and 123 is lower than the second turn-on voltage of the second light emitting groups 121 and 124.

The direct current power supply unit 110, the voltage control unit 130, and the light emitting unit 120 may be mounted on one substrate. Particularly, the first light emitting groups 122 and 123 are arranged inside the second light emitting groups in the light emitting unit 120 mounted on the substrate. This arrangement allows the first light emitting groups 122 and 123 and the second light emitting groups 121 and 124 to sequentially emit light from the inside depending on the level of the voltage applied to the light emitting unit 120.

Referring next to FIGS. 3 and 4, the operating characteristics of the lighting apparatus will be explained together with those of the light emitting unit. Referring to FIG. 3, the voltage control unit 130 is located between the direct current power supply unit 110 and the light emitting unit 120. The voltage control unit 130 includes a variable resistor Rt. The level of a voltage applied to the variable resistor Rt is controlled by varying the variable resistor Rt so that the level of a voltage applied to the light emitting unit 120 from the direct current power supply unit 110 can be controlled.

The voltage control unit 130 is a T-type circuit that has branch resistors Rt, R1, and R2 in its branches. In the embodiment of FIG. 3, the branch resistor Rt between the central node Nc and a positive electrode (+) of the direct current power supply unit 110 is a variable resistor. The characteristics of a voltage $V_{Rt}$ applied to the variable resistor Rt and a voltage $V_{R2}$ applied to the light emitting unit 120 according to the insertion of the voltage control unit 130 are plotted in FIG. 4. As a result of analyzing the voltage control unit 130, the voltage $V_{Rt}$ applied to the variable resistor Rt can be expressed by Equation 1:

$$V_{Rt}=(Rt*V_S)/\{Rt+(R1//R2)\} \quad (1)$$

As can be seen from this equation, the $V_{Rt}$ is proportional to the controlled variable resistor Rt. The level increases in the order: $0<V_{Rt}<Vs$, which is graphically shown as curve g1 in FIG. 4. The voltage applied to the light emitting unit 120, i.e. the $V_{R2}$ applied to the $R_2$, can be expressed by Equation 2:

$$V_{R2}=V_S-V_{Rt}=V_S-(Rt*V_S)/\{Rt+(R1//R2)\}=V_S*[R1*R2/\{Rt*(R1+R2)+R1*R2\}] \quad (2)$$

When the variable resistor Rt varies, the $V_{R2}$ exhibits characteristics shown as curve g2 in FIG. 4. Since the $V_{R2}$ can be defined as a voltage applied to the light emitting unit 120 (where the R1 acts as a resistor determining a current flowing into the light emitting unit 120 in the circuit), the light emitting unit 120 does not operate when the $V_{R2}$ is lower than the first turn-on voltage $V_B$, that is, when the variable resistor Rt is greater than Rt2. When the variable resistor Rt is adjusted to a value between the Rt1 and the Rt2, the $V_{R2}$ lies between the first turn-on voltage $V_B$ and the second turn-on voltage $V_A$ (area S1). At this time, only the first light emitting groups 122 and 123 emit light. Meanwhile, when the variable resistor Rt is adjusted to a value lower than the Rt1, the $V_{R2}$ becomes greater than the second turn-on voltage $V_A$ (area S2). In the area S2, the first light emitting groups 122 and 123 and the second light emitting groups 121 and 124 emit light simultaneously. Accordingly, appropriate control over the variable resistor Rt of the voltage control unit 130 allows only the first light emitting groups 122 and 123 to emit warm white light or the first light emitting groups 122 and 123 and the second light emitting groups 121 and 124 to emit warm white light and cool white light, respectively.

FIGS. 5 and 6 shows the configuration of a T-type circuit as the voltage control unit 130 and explains an arrangement of the variable resistor Rt between the central node Nc of the T-type circuit and a negative (−) electrode of the direct current power supply unit 110. The voltage $V_{Rt}$ applied to the variable resistor Rt can be expressed by Equation 3:

$$V_{Rt}=V_S*[R1/\{R1*R2/Rt+(R1+R2)\}] \quad (3)$$

Since the voltage applied to the variable resistor Rt can be defined as a voltage applied to the light emitting unit 120 (where the R1 acts as a resistor determining a current flowing into the light emitting unit 120 in the circuit), it exhibits characteristics shown as curve g3 in FIG. 6. The light emitting unit 120 does not operate when the variable resistor Rt is adjusted to a value lower than the Rt1. When the variable resistor Rt is adjusted to a value between the Rt1 and the Rt2, the $V_{Rt}$ lies between the first turn-on voltage $V_B$ and the second turn-on voltage $V_A$. At this time, only the first light emitting groups 122 and 123 emit light. Meanwhile, when the variable resistor Rt is adjusted to a value greater than the Rt2 (area S2), the $V_{Rt}$ becomes greater than the second turn-on voltage $V_A$. In the area S2, the first light emitting groups 122 and 123 and the second light emitting groups 121 and 124 emit light simultaneously. Accordingly, appropriate control over the variable resistor Rt of the voltage control unit 130 allows only the first light emitting groups 122 and 123 to emit warm white light or the first light emitting groups 122 and 123 and the second light emitting groups 121 and 124 to emit warm white light and cool white light, respectively.

FIGS. 7 and 8 shows the configuration of a T-type circuit as the voltage control unit 130 and explains an arrangement of the variable resistor Rt between the central node Nc of the T-type circuit and an input end N1 of the light emitting unit 120.

The voltage $V_{R2}$ applied to the variable resistor Rt can be expressed by Equation 4:

$$V_{R2}=V_S*[R2/\{(R1+R2)+R1*R2/Rt\}] \quad (4)$$

Since the voltage applied to the variable resistor Rt can be defined as a voltage applied to the light emitting unit 120 (where the Rt acts as a resistor determining a current flowing into the light emitting unit 120 in the circuit), it exhibits characteristics shown as curve g4 in FIG. 8. The light emitting unit 120 does not operate when the variable resistor Rt is lower than the Rt1. When the variable resistor Rt is adjusted to a value between the Rt1 and the Rt2, the $V_{Rt}$ lies between the first turn-on voltage $V_B$ and the second turn-on voltage $V_A$ (area S1). At this time, only the first light emitting groups 122 and 123 emit light. Meanwhile, when the variable resistor Rt is adjusted to a value greater than the Rt2, the $V_{R2}$ becomes greater than the second turn-on voltage $V_A$ (area S2). In the area S2, the first light emitting groups 122 and 123 and the second light emitting groups 121 and 124 emit light simultaneously. Accordingly, appropriate control over the variable resistor Rt of the voltage control unit 130 allows only the first light emitting groups 122 and 123 to emit warm white light or the first light emitting groups 122 and 123 and the second light emitting groups 121 and 124 to emit warm white light and cool white light, respectively.

In the last one of the three types explained above, the variable resistor Rt is arranged between the central node Nc of the T-type circuit and the input end N1 of the light emitting unit 120. In this case, since the variable resistor Rt is directly connected in series with the light emitting unit 120, a current flowing into the light emitting unit 120 should also be taken into consideration. For this reason, the last type is unfavorable compared to the two previous arrangements. As mentioned earlier, the light emitting unit 120 can emit white light having a correlated color temperature of 3000 K to 8000 K over its entire area.

Although the insertion of the T-type circuit as the voltage control unit 130 of the lighting apparatus has been explained with reference to FIGS. 3 to 8, the present invention is not limited thereto and the voltage control unit 130 may be designed to include suitable for circuits and elements for controlling the voltage applied to the light emitting unit 120.

As is apparent from the foregoing, the lighting apparatus of the present invention is constructed such that the second light emitting groups emit cool white light or are prevented from emitting cool white light by controlling their turn-on voltage during operation of the first light emitting groups emitting warm white light. Due to this construction, the area of non-light emitting regions in the light emitting groups can be minimized, achieving high efficiency of the lighting apparatus and enabling the construction of the lighting apparatus at a reduced cost.

What is claimed is:

1. A lighting apparatus comprising:

a direct current power supply unit;

a light emitting unit operating in response to a direct current voltage applied from the direct current power supply unit and comprising first light emitting groups having a first correlated color temperature and being turned on at a first turn-on voltage ($V_B$) or above and second light emitting groups having a second correlated color temperature and being turned on at a second turn-on voltage ($V_A$) greater than the first turn-on voltage, the first light emitting groups being connected in parallel with the second light emitting groups; and a voltage control unit located between the direct current power supply unit and the light emitting unit to control a level of a voltage applied from the direct current power supply unit to the light emitting unit, wherein the voltage control unit comprises at least one variable resistor to control the level of the voltage applied to the light emitting unit such that the second light emitting groups emit light or are prevented from emitting light, achieving a desired correlated color temperature according to a preset proportion.

2. The lighting apparatus according to claim 1, further comprising a substrate on which the first light emitting groups are arranged inside the second light emitting groups.

3. The lighting apparatus according to claim 1, wherein the first and second light emitting groups are configured to emit light sequentially according to levels of the turn-on voltages.

4. The lighting apparatus according to claim 1, wherein each of the first light emitting groups comprises one or more light emitting diodes emitting warm white light having a correlated color temperature of 3000 K or less.

5. The lighting apparatus according to claim 1, wherein each of the second light emitting groups comprises one or more light emitting diodes emitting cool white light having a correlated color temperature of 5000 K or less.

6. The lighting apparatus according to claim 1, wherein each of the first light emitting groups comprises one or more light emitting diodes emitting white light having a correlated color temperature of 3000 K or less and each of the second light emitting groups comprises one or more light emitting diodes emitting cool white light having a correlated color temperature of 5000 K or less.

7. The lighting apparatus according to claim 1, wherein the light emitting unit emits white light having a correlated color temperature of 3000 K to 8000 K.

8. The lighting apparatus according to claim 1, wherein the voltage control unit operates in such a manner that a voltage having a level between the second turn-on voltage and the first turn-on voltage is applied to the light emitting unit to turn on only the first light emitting groups or a voltage greater than the second turn-on voltage is applied to the light emitting unit to turn on both the first and second light emitting groups.

9. The lighting apparatus according to claim 8, wherein a branch resistor between a central node of a T-type circuit and a positive electrode of the direct current power supply unit is a variable resistor.

10. The lighting apparatus according to claim 8, wherein a branch resistor between a central node of a T-type circuit and a negative electrode of the direct current power supply unit is a variable resistor.

11. The lighting apparatus according to claim 8, wherein a branch resistor between a central node of a T-type circuit and an input end of the light emitting unit is a variable resistor.

12. The lighting apparatus according to claim 1, wherein the voltage control unit comprises a T-type circuit having resistors in branches of the T-type circuit.

* * * * *